United States Patent [19]

Mullich et al.

[11] 4,300,374

[45] Nov. 17, 1981

[54] KEY RETAINING CYLINDER FOR A LOCK

[75] Inventors: Richard O. Mullich, Burbank; William R. Hunter, Los Angeles, both of Calif.

[73] Assignee: Tre Corporation, Beverly Hills, Calif.

[21] Appl. No.: 61,678

[22] Filed: Jul. 30, 1979

[51] Int. Cl.[3] ..... E05B 11/00; E05B 27/00; E05B 65/06

[52] U.S. Cl. ..... 70/389; 70/134; 70/364 A; 70/372; 70/379 R; 70/DIG. 42

[58] Field of Search ..... 70/389, 372, 379 R, 70/DIG. 42, DIG. 60

[56] References Cited

U.S. PATENT DOCUMENTS

| | | | |
|---|---|---|---|
| 2,194,244 | 3/1940 | Machinist | 70/379 R X |
| 2,469,018 | 5/1949 | Swanson | 70/389 |
| 3,320,781 | 5/1967 | Hill | 70/389 |
| 3,702,550 | 11/1972 | Shimizu | 70/389 X |
| 4,028,917 | 6/1977 | Schlage | 70/389 |
| 4,068,510 | 1/1978 | Neary | 70/DIG. 42 X |

FOREIGN PATENT DOCUMENTS

| | | | |
|---|---|---|---|
| 21634 | 3/1930 | Australia | 70/389 |
| 386620 | of 1933 | United Kingdom | 70/379 R |

*Primary Examiner*—Roy D. Frazier
*Assistant Examiner*—Carl F. Pietruszka
*Attorney, Agent, or Firm*—Blakely, Sokoloff, Taylor & Zafman

[57] ABSTRACT

A key retaining cylinder for a lock operative on standard keys is disclosed. The cylinder of the lock includes an idler ring driven in rotation, with lost motion, by the lock plug. The idler ring is cooperatively disposed with respect to one of the pins so as to restrict the motion thereof when that lock has been used to lock the lock set and to not restrict the movement thereof when that lock has been used to unlock the lock set. Restricted movement of the pin together with the contrapment of the pin within the combinational notch of the key prevents removal of the key. Further features and embodiments are disclosed including provisions for symmetrical operation thereof for left-handed and right-handed doors.

14 Claims, 9 Drawing Figures

Fig. 3
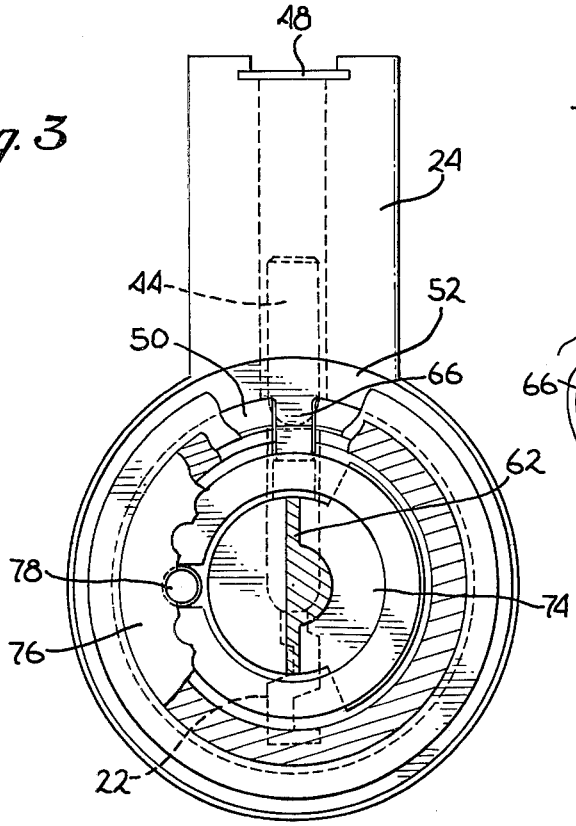
Fig. 2a
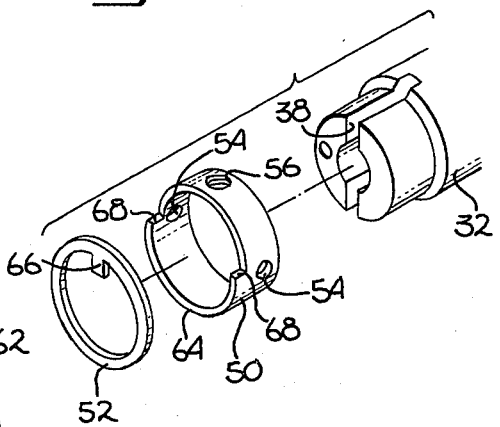
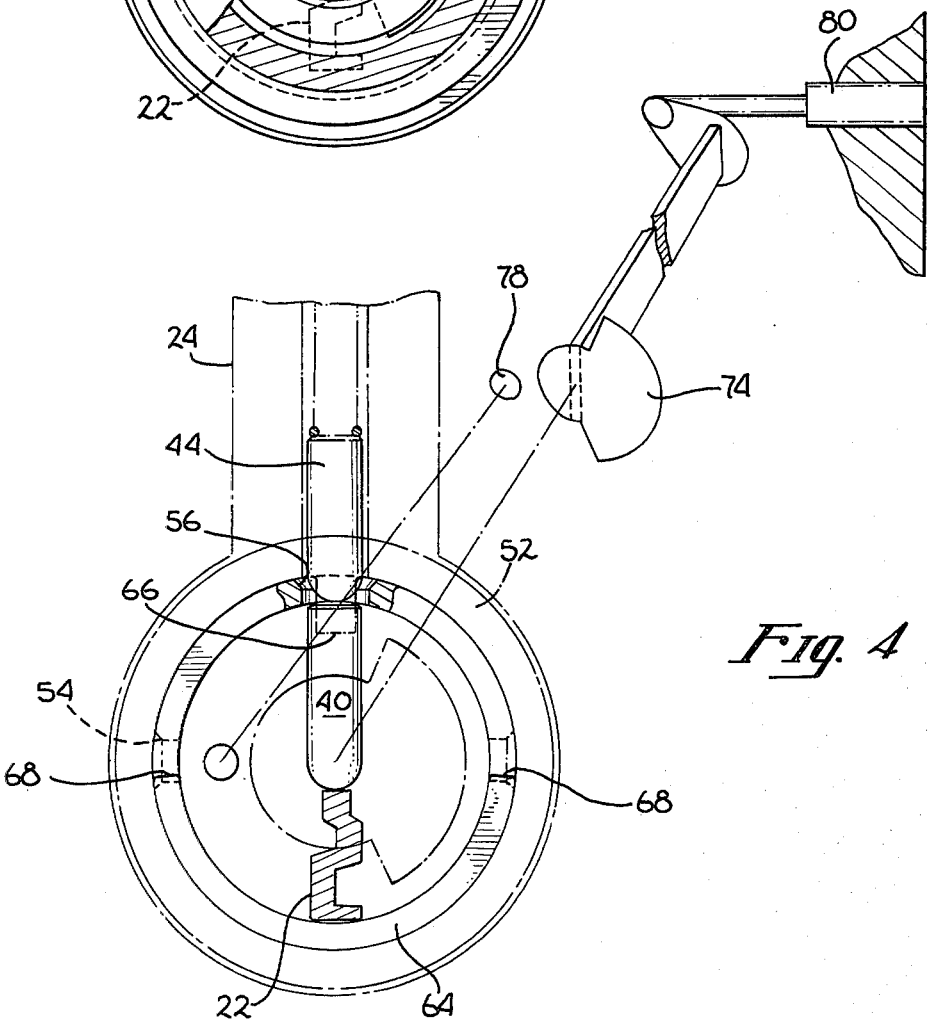
Fig. 4

KEY RETAINING CYLINDER FOR A LOCK

BACKGROUND OF THE INVENTION

1. Field of the Invention

The present invention relates to the field of locks, and more particularly to entry door lock sets.

2. Prior Art

In recent years there has been a steadily increasing trend toward using dead bolts on entry doors which operate from both sides with a key. Such locks have the advantage of higher security when the inner key has been removed, as mere manual access to the interior lock portion will not allow an intruder to withdraw the bolt. This is particularly advantageous when used on doors having window panels or the like, as manual access to the interior lock portion is particularly simple in such instances.

Dead bolts which are only operable from either side by a key have certain disadvantages however. If the dead bolt is locked and the key removed while persons are still within the enclosure protected by the dead bolt, exiting in emergency situations can require precious seconds to locate the key and actuate the dead bolt, or could even be prevented if the key were not immediately present. The situation is particularly severe in emergencies such as fire, in that the attendant panic may prevent a person from using the key to unlock the dead bolt even if the key were only a few feet away.

One technique which has been proposed to at least minimize such risks is to provide a special key and plug, used in conjunction with a special central friction shoe in the lock assembly to confine the key in the interior lock if the dead bolt has been extended by that key (i.e. the dead bolt locked from within) but to allow removal of the key from the interior lock if the last operation of the interior lock was to retract the dead bolt. (See U.S. Pat. No. 4,028,917). Such a system is effective to prevent a person locking a dead bolt from within the protected enclosure from thereafter removing the key, so that the key is always in position in the This preserves the rapid exit capability when the protected enclosure is occupied and the risk of burglary is relatively low, but allows the removal of the interior key and thus provides maximum security when the protected enclosures is unoccupied and the risk of burglary is highest. (It should be noted that this concept is not absolutely foolproof, in that if the last operation of the interior lock is to withdraw the dead bolt, the interior key can be removed. Thereafter, if the dead bolt is locked (extended) using the exterior lock while people remain within the enclosure protected by the lock, the interior key will not be in position during a panic situation. This, however, normally would be the exception rather than the rule, whereas without such a provision the interior key may be indiscriminately removed at any time.)

The lock of U.S. Pat. No. 4,028,917 has a plug which in addition to the standard key slot is also slotted in a plane perpendicular to its axis, the slot extending from a position directly opposite the key slot and being slotted through over half its cross-section. In addition, a peripheral groove of some substantial depth is cut in the plug in axial alignment with the slot so as to intersect the edge of the key slot. A spring clip generally in the form of an arc segment of substantially greater than 180° is located in the slot of the plug, with the legs thereof extending into the peripheral groove so as to be rotatable with respect thereto to intersect the edge of the key slot. This, in conjunction with a cooperatively disposed slot on the back edge of the blade of the key, provides for the confinement of the key dependent upon the position of the spring member. A tab on the spring member in cooperation with the slot provides a lost motion between the plug and the spring member so that the spring member will retain the key when used to extend the dead bolt and will allow the withdrawal of the key after being used to retract the dead bolt.

The foregoing prior art system has certain advantages in that it achieves the desired result with a relatively simple mechanism. It has certain disadvantages however including the fact that the plug is grossly weakened and that it requires a special key having an appropriately disposed slot therein.

BRIEF SUMMARY OF THE INVENTION

A key retaining cylinder for a lock operative on standard keys is disclosed. The cylinder of the lock includes an indexing ring driven in rotation, with lost motion, by the lock plug. The indexing ring is cooperatively disposed with respect to one set of pins so as to restrict the motion thereof when that lock has been used to lock the lock set, and to not restrict the movement thereof when that lock has been used to unlock the lock set. Restricted movement of the pin together with the entrapment of the pin within the combinational notch of the key prevents removal of the key. Further features and embodiments are disclosed, including provisions for symmetrical operation thereof for left-handed and right-handed doors.

BRIEF DESCRIPTION OF THE DRAWINGS

FIG. 2*a* is a perspective view with a portion of the plug, indexing ring and drive ring of FIG. 2.

FIG. 3 is a view taken along line 3—3 of FIG. 2.

FIGS. 4–8 are schematic illustrations of various phases of operation of the key retaining means in accordance with the preferred embodiments of FIG. 2.

DETAILED DESCRIPTION OF THE INVENTION

Figure 1:
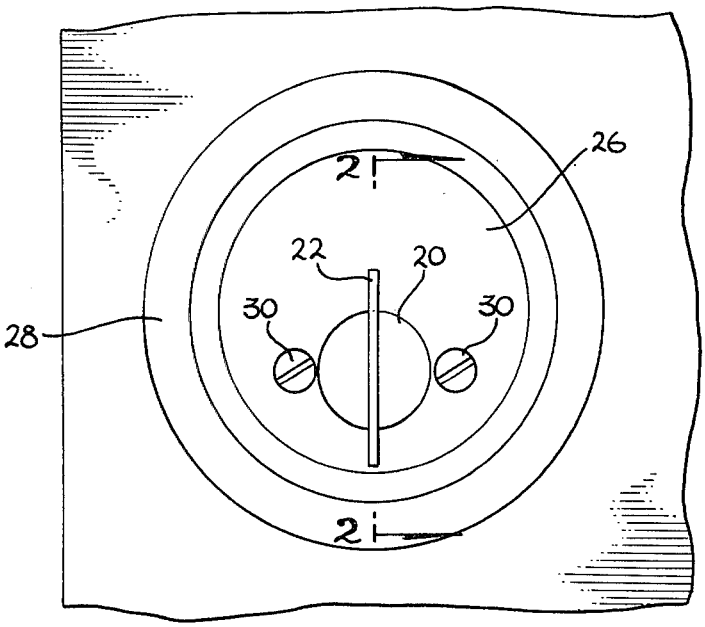
FIG. 1 is a face view of a key actuated interior lock mechanism for a dead bolt which may incorporate the present invention.

First referring to FIG. 1, a face view of an interior lock assembly incorporating the present invention may be seen. In all appearance this interior lock assembly is identical to prior art lock assemblies. Thus, visible in the figure is the end of the lock plug 32 having a key slot therein for receiving a key 22. The plug 32, of course, is disposed within a cylinder 24 (see FIG. 2) with the cylinder in turn being mounted within a protective housing assembly and covered by decorative elements 26 and 28. A similar assembly is normally mounted on the door exterior, with the two assemblies being held together in position on the door by mounting screws 30 extending from the interior lock assembly to the exterior assembly.

Figure 2:
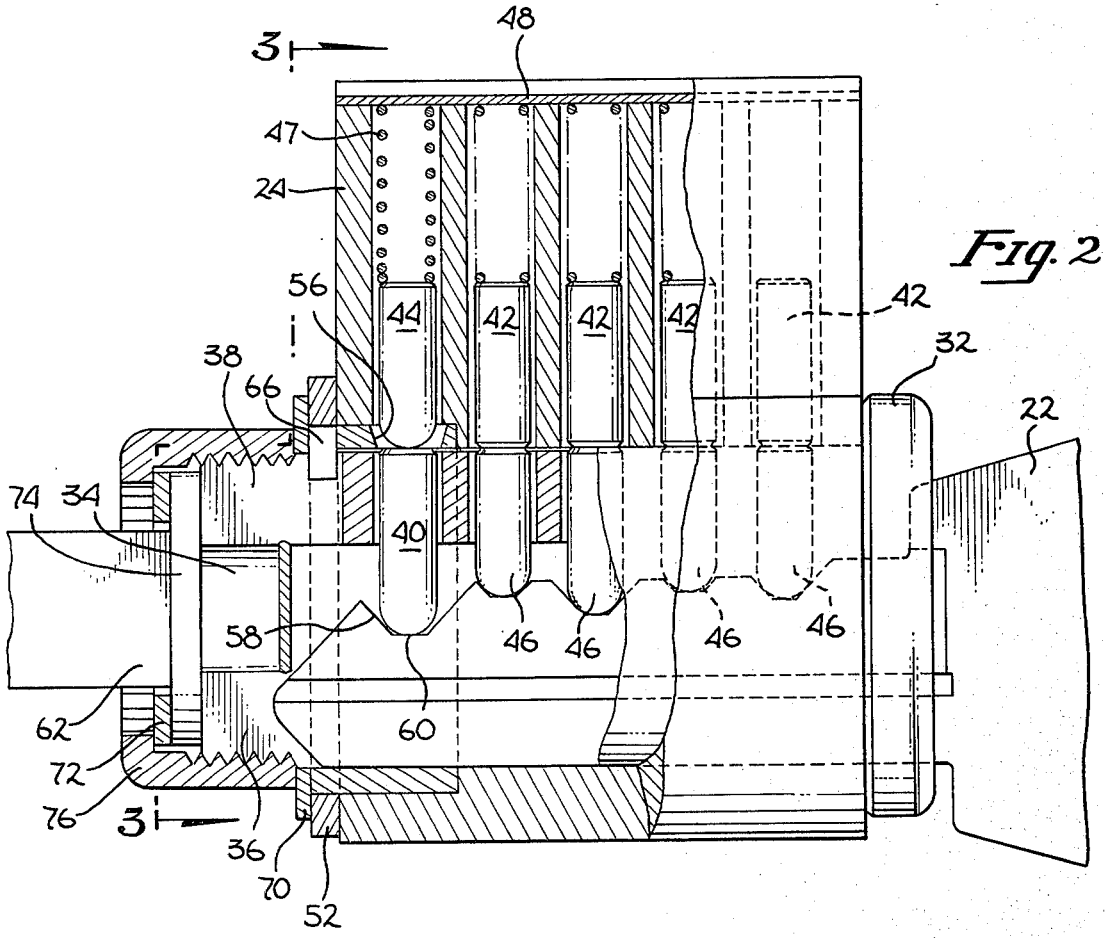
FIG. 2 is a cross-section taken along line 2—2 of FIG. 1 illustrating the preferred embodiment of the present invention therein.

Now referring to FIG. 2, a cross-section taken along line 2—2 of FIG. 1 may be seen. The lock plug 32 of this embodiment is generally slotted across the end 34, the lower portion 36 of the slot representing an extension of the key slot therein, and the upper portion 38 of the slot being of relatively limited axial extent, terminating prior to the hole for the first combinational pin 40. The cylinder 24 contains five pins, four of which are identified by the numeral 42 and the last of which is identified by the numeral 44. Each of these pins is contained within one of the cooperatively disposed holes in the cylinder body so as to fall in alignment with the respective combinational pins 40 and 46 in the plug 32. The pins 42 and 44 are each encouraged downward by a coil spring 47, the coil springs operating against a cover plate 48 (see also FIG. 3) retained in a groove at the top of the cylinder body.

In this embodiment the plug in the region of the combinational pins 40 and 46 is of a uniform diameter, whereas the cylinder body 24 is of uniform diameter in the region of pins 42, though steps to a larger diameter in the region of pin 44. Disposed within the annular space defined by the step in the cylinder inner diameter is an indexing ring 50 having a loose slip fit with respect to both the cylinder and the plug. The indexing ring may be best seen in FIG. 2*a*, which is an exploded perspective view of a portion of the plug 32, the indexing ring 50 and drive ring 52, the function of which is yet to be described. The indexing ring, aside from its slip fit between the plug and cylinder, is characterized by three chamfered holes therein, specifically the two diametrically opposed holes 54 and a third hole 56 at right angles thereto. All three holes are chamfered on the outer diameter of the indexing ring, with hole 56 having a diameter substantially equal to the pin holes in the cylinder and plug so as to allow the free passage of pin 44 therethrough. In that regard, indexing ring 50 is shown in FIG. 2 with opening 56 aligned with pin 44. Holes 54 on the other hand, are smaller in diameter than pin 44, so that the rounded end of the pin 44 may detent into the chamfer thereof but not freely pass therethrough. Also of course, these holes are smaller than the diameter of the combinational pins 40 so that when aligned therewith, pin 40 is not free to move upward beyond the plug diameter. As shall be subsequently described in greater detail, it is this aspect which provides for the retention of the key 22, in that removal of the key from the lock is impossible without pin 40 moving upward from the position shown because of the forward edge portion 58 of the first combinational notch 60 in the key.

The indexing ring 50 is also characterized by a step in its length on the end thereof facing the tail piece 62, the lower sector thereof 64 defining an arc segment of somewhat less than 180°. The drive ring 52 (see both FIGS. 2 and 2*a*) has an inward directed tab 66 which extends radially inward beyond the thickness of the indexing ring and into the slot portion 38 in the end of the plug 32. In this manner the drive ring 52 will be driven in rotation substantially directly by the plug, though the indexing ring 50 will be driven in rotation by the drive ring 52 only by the engagement of tab 66 with surfaces 68 on the indexing ring 50 defined by the protrusion 64 thereon. Thus, while the drive of the drive ring 52 by the plug is substantially direct, the drive of the indexing ring by the drive ring will have substantial lost motion, specifically in the preferred embodiment approximately 180° of lost motion.

The remaining elements of the cylinder assembly comprise washers 70 and 72, tail piece 62 with a conventional arc sector member 74 thereon, and a retaining collar 76, the retaining collar being threaded onto the back of the plug and retained thereon by a spring loaded pin 78 (see FIG. 3), which together with the sector member provides for a lost motion drive of the tail piece.

Now referring to FIGS. 4 through 8, schematic illustrations of the various stages of operation of the structure hereinbefore described may be seen. Where appropriate, various elements even though shown schematically are identified by the same numerals as used in the previous figures for easy reference thereto. Starting with FIG. 4 the plug, indexing ring and dead bolt 80 are all illustrated in the unlocked position, that is with the dead bolt withdrawn and the interior lock mechanism in a condition whereby the key may be readily removed and inserted without restraint. It may be seen that in this position the indexing ring 50 is angularly positioned so that the opening 56 therein aligns with pins 40 and 44. In that regard, FIG. 4 is a schematic illustration of the state of the interior lock assembly corresponding to that shown in FIG. 2.

Figure 5:
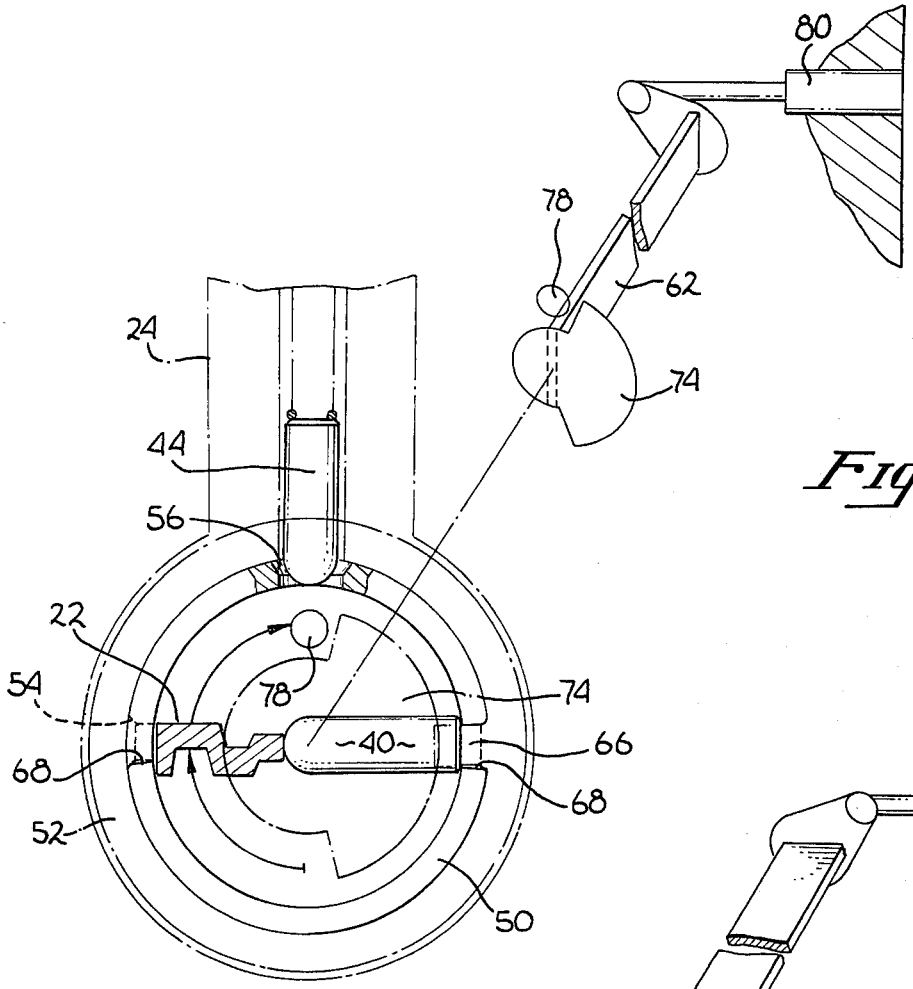
Figure 6:
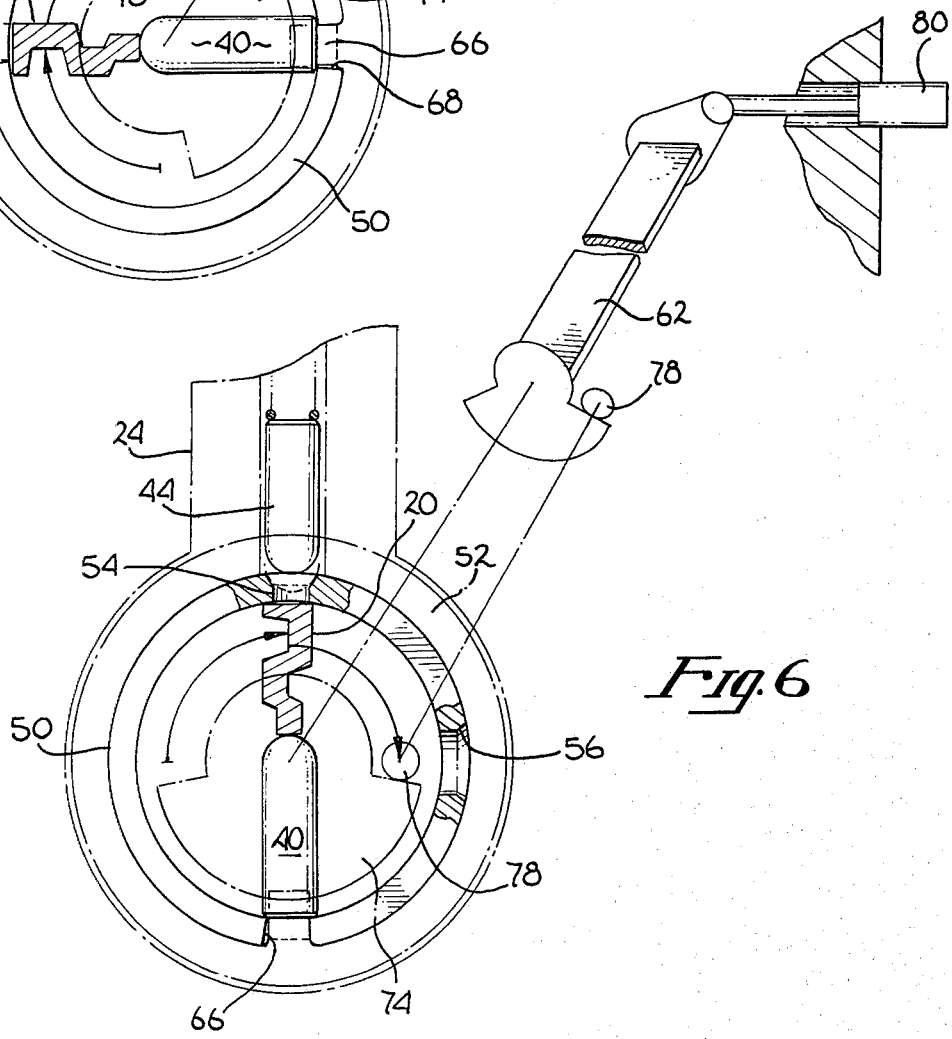
Figure 7:
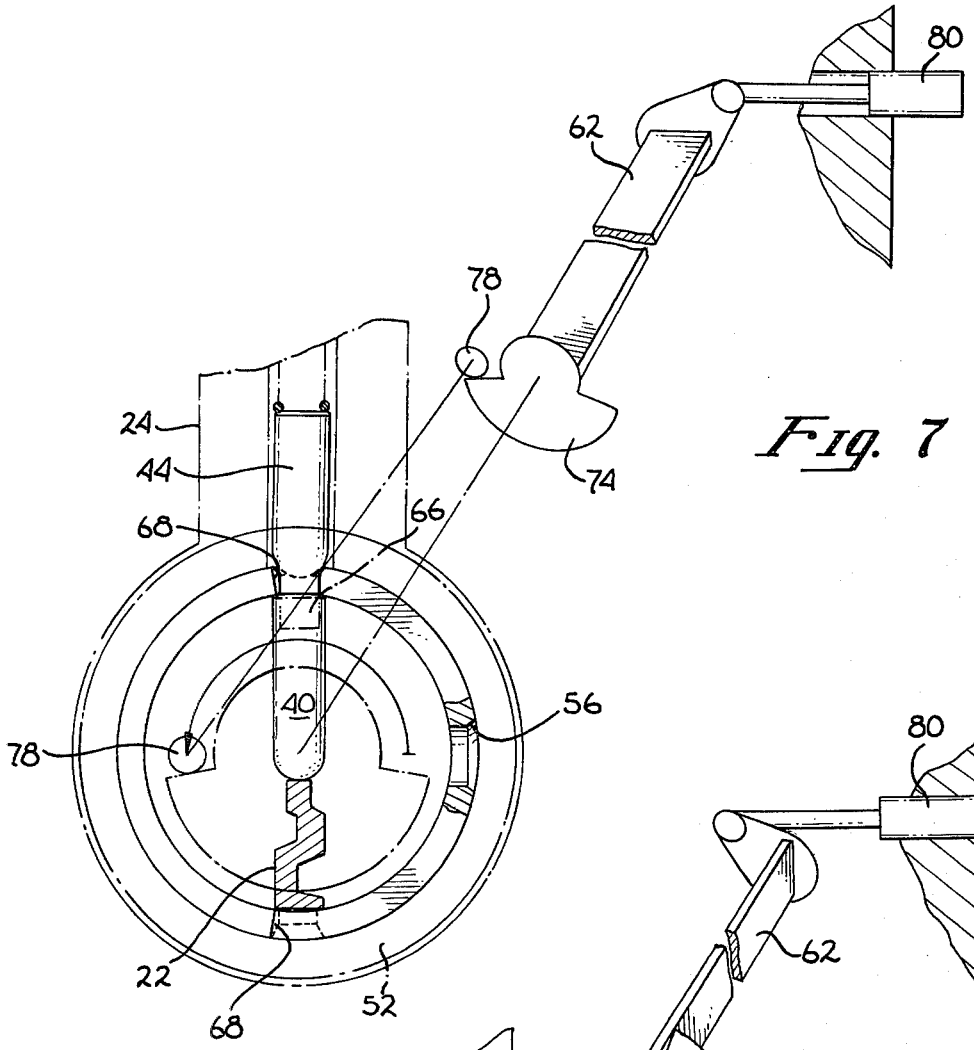
Figure 8:
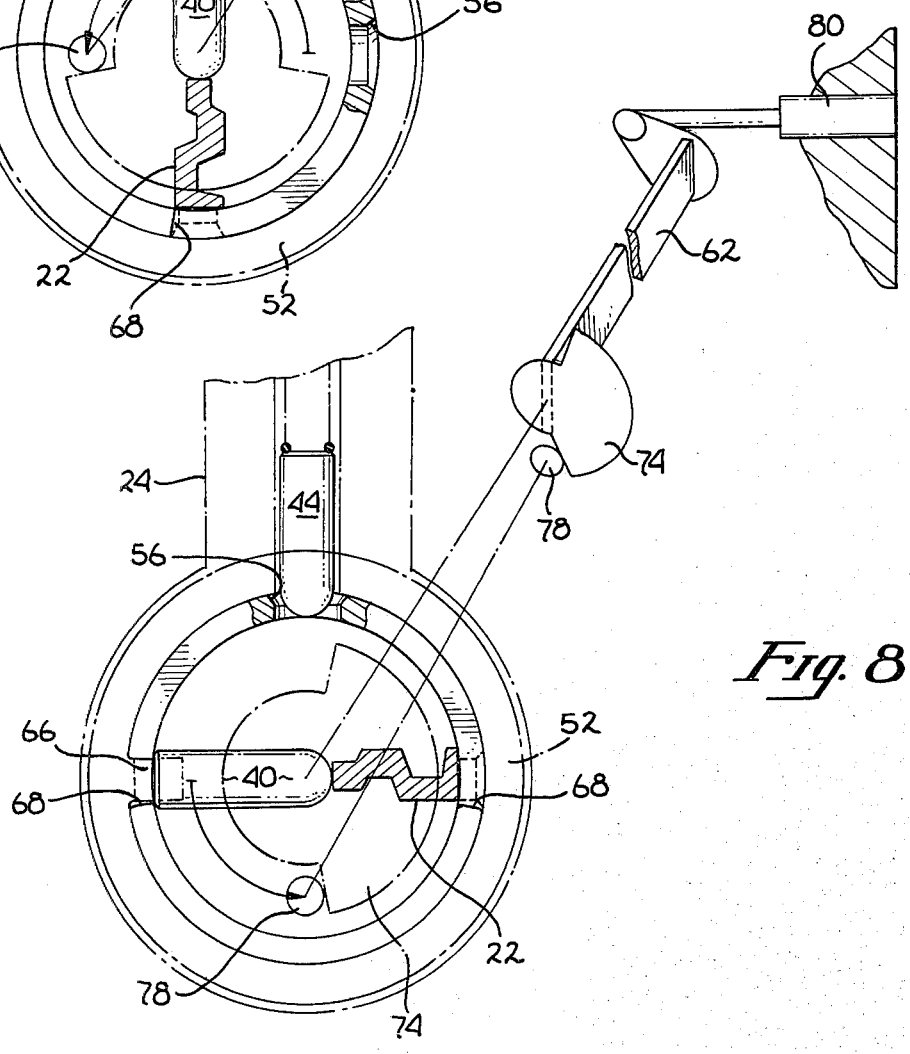

When the plug is rotated clockwise toward the locked position, the first 90° of motion takes up the lost motion between the pin 78 and the sector member 74. At the same time the lost motion between tab 66 and surface 68 of the indexing ring 50 is taken up, as illustrated in FIG. 5. Finally, a further rotation of 90°, as illustrated in FIG. 6, rotates the tail piece 62 so as to extend the dead bolt, and also rotates the indexing ring 50 90° so that pin 44 detents into one of holes 54 therein. In this position the lost motion on the index ring drive and the lost motion on the tail piece drive, both being approximately 180°, are both at one extreme so that upon rotation of the plug 180° in the counterclockwise direction to what would normally be the key removal position, neither the dead bolt nor the indexing ring change position. This is illustrated in FIG. 7. It should be noted that in this position pin 40 is restricted in vertical movement as the hole 54 is too small to allow the passage of the pin thereto. Consequently, this in cooperation with the edge 58 of the combinational notch 60 in key 22 prevents the removal of the key from the lock. Thus it may be seen that extending the dead bolt using the interior lock results in the rotation of the indexing ring to a position preventing the subsequent withdrawal of the key from the lock when rotated to the normal key removal position. The cycle is completed, of course, when the plug is rotated counterclockwise 90° from the normal key removal position as illustrated in FIG. 8, as such rotation not only causes pin 78 to rotate the tail piece 74 so as to withdraw the dead bolt, but tab 66 also causes rotation of the indexing ring 50 back to the initial position illustrated in FIGS. 2 and 4 to bring hole 56 in alignment with pin 44. Thus, now when the lock is rotated back to the normal key removal position, the key may be freely removed as the motion of pins 40 and 44 is no longer restricted.

Having now described one specific embodiment of the present invention, various alternate forms will become apparent. In general it will be noted that one aspect of the present invention is the addition of an indexing member, allowing the normal operation of a pair of pins when in one position and interferring with that operation when in a second position. In that regard it is convenient to give the indexing ring the same lost motion as the dead bolt drive, though this is not a specific requirement or limitation of the invention, as proper operation may be obtained with different amounts of lost motion provided the indexing ring or member is in one functional position when the plug approaches the key removal position from the dead bolt extending position and in the other functional position when the plug approaches the key removal position from the dead bolt retracting position. Obviously an indexing member; whether in the form of a ring or having other configurations, could be operable with any pair of pins, though the end set of pins particularly the tail piece end set of pins, is most convenient.

It should be noted that the holes 54 as well as the hole 56 in the indexing ring 50 are through holes with the outer periphery thereof being chamfered. The purpose of the chamfer of course is to allow the bottom of pin 44 to detent therein so as to restrain the rotation of the indexing ring against any friction between the plug and the ring, but to allow the positive driving of the indexing ring to other positions as required. Obviosly this detenting function would be served with any notch or depression on the periphery of the indexing ring, so that through holes 54 are used only as a matter of convenience and not as a specific structural requirement for the invention. In that regard, while hole 56 obviously must be a through hole of sufficient size to allow movement of the pins therethrough the function of holes 54 would be served by any means which provided restraint of the indexing member against unintended motion as a result of rotation of the plug. By way of example, the friction between the bottom tip of pin 44 and the periphery of the indexing ring will tend to restrain the rotation of the ring, though generally speaking substantially more restraint is desired, and a detenting mechanism as described is most preferred.

It should be noted that a typical lock mechanism for operating a dead bolt mates with the dead bolt mechanism itself through the tail piece in such a way as to reverse in rotational direction for left-handed vs. right-handed doors. By using a symmetrical indexing member having a lost motion matching that of the tail piece drive the key retaining function of the cylinder is also preserved between left-handed and right-handed installations. Thus, it will be noted that the indexing ring 50 of the preferred embodiment has approximately 180° of lost motion as does the tail piece drive, and that the two detent holes 54 therein are 180° apart and each 90° from the normal operating hole 56. Such a configuration makes the entire lock assembly reversible between left-handed and right-handed doors merely by proper engagement of the tail piece with the dead bolt actuating mechanism.

There has been disclosed and described herein one specific embodiment of the present invention for retaining the key in an interior lock assembly after having been locked with that key, together with various exemplary alternate forms thereof. Thus from this disclosure it will be obvious from those skilled in the art that various further changes in form and detail may be made therein without departing from the spirit and scope of the invention.

We claim:

1. A key retaining cylinder lock for operating a bolt comprising:

a cylinder having a plurality of pins therein;

a plug within said cylinder, said plug having a keyway therein for receiving a key, and having a plurality of combinational pins cooperatively disposed with respect to said keyway and said pins in said cylinder when said plug is in a first angular position with respect to said cylinder to position all of said pins to allow rotation of said plug away from said first plug position toward a second plug position for extending a bolt and in an opposite direction toward a third plug position for withdrawing a bolt on insertion of a matching key having a plurlity of combinational notches therein;

indexing means responsive to the rotation of said plug, said indexing means being a means for preventing movement of at least one combinational pin out of the respective combinational notch in the matching key when said plug is rotated to said first position from said second position to prevent removal of the key from said plug and for not confining movement of said at least one combinational pin out of the respective combinational notch when said plug is rotated to said first position from said third position to allow removal of the key from said plug.

2. The key retaining cylinder lock of claim 1 wherein said indexing means is symmetrically operable for left-handed and right-handed doors.

3. The key retaining cylinder lock of claim 1 wherein said indexing means is an indexing member disposed between said plug and said cylinder.

4. The key retaining cylinder lock of claim 3 wherein said indexing member is coupled to said plug through a lost motion drive.

5. The key retaining cylinder lock of claim 4 further comprised of means for inhibiting the motion of said indexing member when not being driven by said lost motion drive.

6. The key retaining cylinder lock of claim 5 wherein said means for inhibiting the motion of said indexing member is a detent means.

7. A key retaining cylinder lock for operating a bolt comprising:

a cylinder having a plurality of pins therein;

a plug within said cylinder, said plug having a keyway therein for receiving a key, and having a plurality of combinational pins cooperatively disposed with respect to said keyway and said pins in said cylinder when said plug is in a first angular position with respect to said cylinder to position all of said pins to allow rotation of said plug away from said first plug position toward a second plug position for extending a bolt and in an opposite direction toward a third plug position for withdrawing a bolt on insertion of a matching key having a plurality of combinational notches therein;

an indexing member disposed between said plug and said cylinder and being coupled to said plug through a lost motion drive, said indexing member being disposed over at least one combinational pin in said plug, and having at least one hole therein for passage of said at least one combinational pin therethrough when said hole is aligned therewith, responsive to the rotation of said plug, said indexing member being a means for preventing movement of at least one combinational pin out of the respective combinational notch in the matching key when said plug is rotated to said first position from said second position to prevent removal of the key from said plug and for not confining movement of said at least one combinational pin out of the respective combinational notch by allowing said at least one combination pin to pass into said at least one hole in said indexing member when said plug is rotated to said first position from said third position to allow removal of the key from said plug.

8. The key retaining cylinder lock of claim 7 wherein said indexing member has at least one depression in the outer surface thereof for engaging the associated cylinder pin to provide a detent thereto.

9. A key retaining cylinder lock for operating a dead bolt mechanism comprising:

a cylinder assembly having a plurality of spring-loaded pins therein;

a plug within said cylinder, said plug having a keyway therein for receiving a key, and having a plurality of combinational pins cooperatively disposed with respect to said keyway and said spring-loaded pins in said cylinder when said plug is in a first angular position with respect to said cylinder to position all of said pins to allow rotation of said plug away from a first plug position toward a second plug position for extending a deadbolt and in an opposite direction toward a third plug position for withdrawing a deadbolt on insertion of a matching key having a plurality of combinational notches therein;

a tail piece means coupled to said plug through a first lost motion drive, said tail piece means being a means for engaging and operating the dead bolt mechanism between the extended and retracted positions responsive to rotation of said plug; and an indexing member coupled to said plug through a second lost motion drive, said indexing member being in a position restricting movement of at least one combinational pin out of a combinational notch in the matching key when said plug is rotated to said first position from said secondposition to prevent removal of the key from said plug and being in a position not restricting movement of said at least one combinational pin out of the combinational notch when said plug is rotated to said first position from said third position.

10. The key retaining cylinder lock of claim 9 further comprised of means for inhibiting the motion of said indexing member when not being driven by said second lost motion drive.

11. The key retaining cylinder lock of claim 10 wherein said means for inhibiting the motion of said indexing member is a detent means.

12. The key retaining cylinder lock of claim 9 wherein said first and second lost motion drives have approximately the same lost motion.

13. A key retaining cylinder lock for operating a dead bolt mechansim comprising:

a cylinder assembly having a plurality of spring-loaded pins therein;

a plug within said cylinder, said plug having a keyway therein for receiving a key, and having a plurality of combinational pins cooperatively disposed with respect to said keyway and said spring-loaded pins in said cylinder when said plug is in a first angular position with respect to said cylinder to position all of said pins to allow rotation of said plug away from a first plug position toward a second plug position for extending a deadbolt and in an opposite direction toward a third plug position for withdrawing a deadbolt on insertion of a matching key having a plurality of combinational notches therein;

a tail piece means coupled to said plug through a first lost motion drive, said tail piece means being a means for engaging and operating the dead bolt mechanism between the extended and retracted positions responsive to rotation of said plug; and an indexing ring, said indexing ring fitting within an annular relief in the bore of said cylinder so as to encircle said plug in the region of one combinational pin, said ring having a hole therein for the free passage of said combinational pin when said hole is aligned with said combinational pin, said indexing ring being coupled to said plug through a second lost motion drive, said first and second lost motion drives having approximately the same lost motion, said indexing member being in a position restricting movement of a combinational pin out of a combinational notch in the matching key when said plug is rotated to said first position from said second position to prevent removal of the key from said plug and being in a position not restricting movement of said combinational pin out of the combinational notch by allowing said combinational pin to pass into said hole in said indexing ring when said plug is rotated to said first position from said third position.

14. The key retaining cylinder lock of claim 13 wherein said ring has detent means on the outer surface thereof angularly spaced to each side of said hole for detenting on the respective pin in said cylinder.

* * * * *